US007150368B2

(12) United States Patent
Scott

(10) Patent No.: US 7,150,368 B2
(45) Date of Patent: Dec. 19, 2006

(54) CUSHIONING DEVICE HAVING AN ELECTRICALLY ACTUATED LOCKOUT

(75) Inventor: Mark Scott, Boiling Springs, PA (US)

(73) Assignee: Sharma & Associates, Inc., Hinsdale, IL (US)

( * ) Notice: Subject to any disclaimer, the term of this patent is extended or adjusted under 35 U.S.C. 154(b) by 0 days.

(21) Appl. No.: 10/663,115

(22) Filed: Sep. 16, 2003

(65) Prior Publication Data

US 2005/0056607 A1 Mar. 17, 2005

(51) Int. Cl.
*B61G 11/00* (2006.01)

(52) U.S. Cl. ..... 213/43; 213/223

(58) Field of Classification Search ..... 213/43, 213/45, 64, 22, 29, 223; 188/269, 315, 322.13; 267/201, 207, 204, 202
See application file for complete search history.

(56) References Cited

U.S. PATENT DOCUMENTS 1,891,659 A * 12/1932 Tomlinson ..... 213/76
3,301,410 A * 1/1967 Seay ..... 213/43
3,414,134 A * 12/1968 Nealis ..... 213/43
3,450,271 A * 6/1969 Bissett ..... 213/75 D
3,495,719 A * 2/1970 Peppers ..... 213/43
3,525,449 A * 8/1970 Zanow ..... 213/43
3,599,802 A 8/1971 Knippel
3,599,803 A * 8/1971 Cope ..... 213/76
4,040,523 A * 8/1977 Carle et al. ..... 213/46 R
5,104,101 A * 4/1992 Anderson et al. ..... 267/219
5,415,303 A 5/1995 Hodges et al.
5,487,480 A 1/1996 Page et al.
5,551,581 A 9/1996 Kalina
5,586,669 A * 12/1996 Seay et al. ..... 213/43
5,642,823 A 7/1997 Kalina et al.
5,653,425 A 8/1997 Page et al.
5,676,265 A 10/1997 Miller
5,746,335 A 5/1998 Brough et al.
5,762,214 A 6/1998 Bomgardner
5,826,735 A 10/1998 Litten
5,845,796 A 12/1998 Miller
5,871,109 A 2/1999 Litten
6,199,708 B1 3/2001 Monaco
6,237,733 B1 * 5/2001 Kalina et al. ..... 188/315
6,279,765 B1 * 8/2001 Monaco ..... 213/22
6,357,612 B1 * 3/2002 Monaco et al. ..... 213/43
6,398,047 B1 6/2002 Ladendorf et al.
6,814,348 B1 * 11/2004 Leben et al. ..... 267/217

* cited by examiner

*Primary Examiner*—Mark T. Le
(74) *Attorney, Agent, or Firm*—Schwartz Cooper Chartered

(57) ABSTRACT

A rail car cushioning1 device is provided for connecting to a coupler. The rail car cushioning device includes an arrangement of a hydraulic cylinder, a piston assembly, and at least a valve assembly, which are configured with cooperating features to allow the device to be switchable between a locked mode and a cushioning mode.

21 Claims, 11 Drawing Sheets

CUSHIONING DEVICE HAVING AN ELECTRICALLY ACTUATED LOCKOUT

TECHNICAL FIELD

The present invention relates to cushioning devices used to absorb impacts between devices such as, but not limited to, rail cars. More particularly, the present invention relates to a cushioning device having an actuated lockout mechanism, enabling the device to be switched between a cushioning mode and locked mode.

BACKGROUND OF THE INVENTION

Train make-up and coupling operations typically involve high longitudinal force buff and draft impacts between the rail cars. End-of-Car cushioning devices are used to absorb these impacts, thus protecting the rail car and lading from damage. End-of-Car cushioning devices are connected to the coupling assembly of the rail car and generally configured to fit underneath the frame of the rail car, at both ends. In this configuration, the coupler of the rail car's coupling assembly is connected to the cushioning device. As such, forces exerted on the coupler are transmitted to the device. Normal in-train forces and impact forces are transmitted through the cushioning device. These devices generally use several gallons of hydraulic fluid to dissipate the several hundred thousand lbs-ft of kinetic energy, enabling the device to absorb impacts of 10 MPH or more, with an effective mass of one or two loaded rail cars.

Because most cushioning devices are configured to absorb high energy impacts instantly, one disadvantage of present devices are that they typically require orifice flow areas too large to appreciably resist the inertia of several rail cars. Especially if the rail cars are formed in a train together and have closing speeds of only one or two feet per second. In this situation, during compression and extension of the typical cushioning device, the device may only provide 10,000 to 20,000 lbs of hydraulic resistance, which is generally insufficient to cease movement of the rail car at such low speeds.

The combined effect of low hydraulic resistance between the cars at low speeds, in compression and extension, and low return spring forces can result in movement between the railcars generally referred to as free slack action. When a significant number of cars joined together in the train have end of car cushioning devices that allow free slack action to occur, resulting inter-car velocities between the rail cars can reach relatively high speeds. Such high inter-car velocities may result in detrimentally high forces between the trains. These undesirable high forces can lead to rail car damage, lading damage, coupler breakage, undesired brake emergencies, and possibly catastrophic rail car derailment.

Preloading is one method generally known to prevent slack action during train operation. Under preload conditions, a pressure relief flow control valve (or valves) is set, for example at the equivalent of 100,000 lbs-ft, and is added to the cushioning device to prevent the cushioning device from stroking until the force of impact between the rail cars exceed the preload force setting. In this arrangement, the cushioning device remains relatively rigid under most train handling conditions, but provides a cushioning effect during train make-up impact conditions. One disadvantage of preloading is that it is a relatively passive system. Additionally, if the preload force level is set for best train handling, it may be too high for protecting lading during impacts, especially with light railcars.

The ability to "lock out" the cushion device on command, preventing the cushioning device from stroking (i.e., extension and compression), can significantly reduce slack action and resulting inter-car velocities and forces. By locking out the cushioning device, thus preventing the device from stroking, a more rigid connection between the rail cars is created, enabling safer train operation, significantly improved ride-quality, and as a result, reduced lading damage. Furthermore, a rigid connection will enable the train to be operated at a high rate of speed.

Currently, the inventor is unaware of any cushioning device in operation that can be switched from cushion mode to locked mode. The AAR Mechanical Rules have provisions for blocking a cushion device from stroking by adding mechanical stops between the exterior moving sections. The purpose is to "lock out" a broken cushion device in order to transport the railcar to a repair facility.

Accordingly, it is desirable to provide a new cushioning device configured for on command locked out. It is desirable that such device: (1) provide impact protection between colliding rail cars during coupling operations; (2) enable on command lock out by positively controlling the stroke of the device via an electrically actuated fluid control shutoff valve; (3) fit existing rail car coupling systems and pocket configurations with little or no modification and; (4) operate using power and activation protocols compatible with existing braking systems.

BRIEF DESCRIPTION OF THE DRAWINGS

In the accompanying drawings forming part of the specification, and in which like numerals are employed to designate like parts throughout the same.

FIG. 4 is a cross-sectional side view of the cushioning device of FIG. 1, illustrating the device in an open cushioning mode with the piston in a partially extended stroke position occurring during impact or run-in;

DETAILED DESCRIPTION OF THE DRAWINGS

This invention is susceptible of embodiments in many different forms. The drawings and descriptions of this application show the preferred embodiment of the invention. The present disclosure is considered to be an example of the principles of the invention. It is not intended to limit the broad aspect of the invention to the illustrated embodiments.

Figure 1:
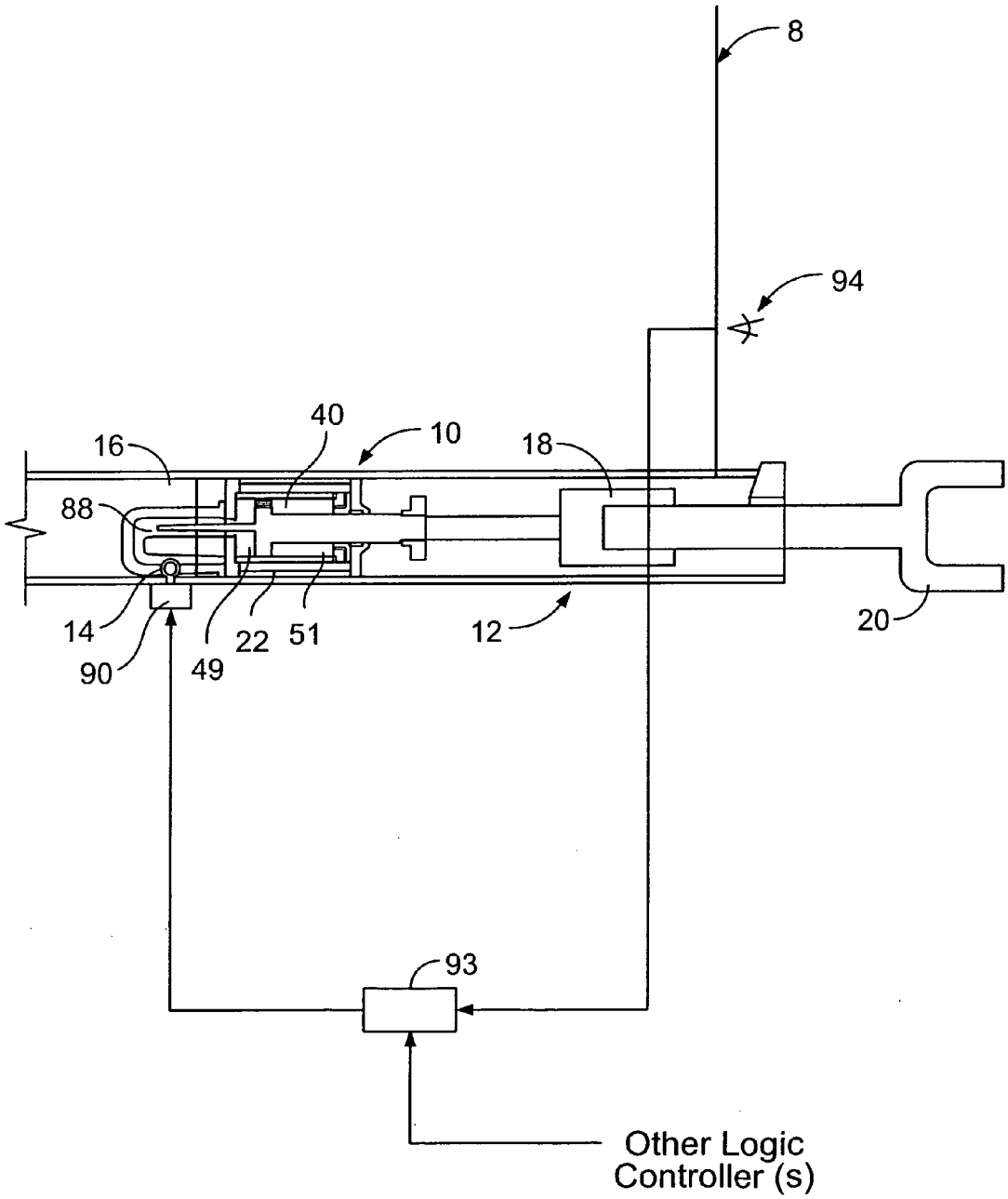
FIG. 1 is a simplified side cross-sectional view and a simplified block diagram of a cushioning device, in accordance with the present invention, attached to a rail car coupling assembly wherein portions of the cushioning device are disproportionally enlarged.

Referring now in detail to the drawings, and initially FIG. 1, there is shown a cushioning device 10 in accordance with the present invention connected to a conventional rail car coupling assembly 12. The cushioning device 10 includes an electrically actuated lockout valve 14 in communication with a controller 93, enabling the device 10 to be switched between a cushioning mode and locked mode, on command.

The cushioning device 10 is adaptable for use in conventional rail car coupling assemblies, end-of-car device pocket configurations, and other similar coupling assemblies, generally known to those skilled in the art. In the present embodiment, the cushioning device 10 is connected to a conventional rail car coupling assembly 12. The coupling assembly 12 includes a sill or frame 16, a yoke 18 and a coupler 20. As illustrated, the sill 16 is generally connected underneath the frame of the rail car 8. The cushioning device 10 is secured to the sill 16 and operably connected to the coupler 20 via the yoke 18. In this manner, the cushioning device 10 is responsive to impacting forces exerted on the coupler 20. Accordingly, movement of the coupler 20 is transmitted to the device 10. Notably, although the disclosed embodiment shows the cushioning device 12 connected to a rail car coupling assembly 12, one skilled in the art will appreciate that the device 10 can be used in a wide variety of cushioning applications, including but not limited to, shipping, building suspension, and piping.

Figure 2:
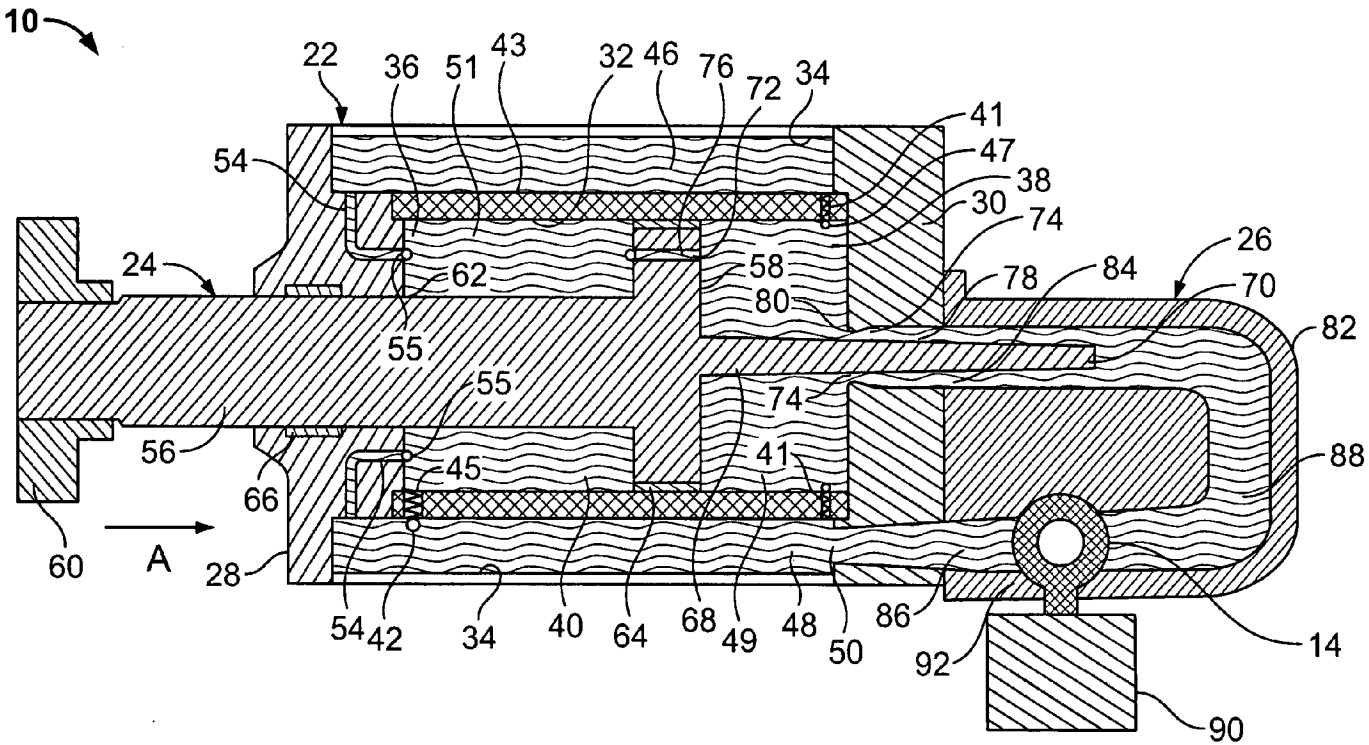
FIG. 2 is a cross-sectional side view of the cushioning device of FIG. 1.

FIG. 2 shows a cross-sectional side view of the cushioning device 10. The device 110 includes a housing 22, a piston 24, and a valve assembly 26. As best seen in FIG. 1, the housing 22 is generally disposed in the sill 16. Preferably, the housing 22 is fixedly secured to the sill 16, however, one skilled in the art will appreciate that the housing 22 can also be slidably mounted to the sill 16.

The housing 22 includes a front end or head 28, a rear end or head 30, a cylinder 32 and a reservoir 34. The front head 28 is positioned at one end of the housing 22, the rear head 30 positioned at the other end of the housing 22, and the cylinder 32 is positioned intermediate to the front head 28 and rear head 30. The housing 22 is constructed from a metal or metal alloy, and attached to the sill 16 in a conventional manner such as by bolting, welding, or the like. Preferably, the metal or metal alloy used in constructing the housing 22 does not require heat treatment if the housing is attached to the sill 16 by welding.

As shown, the cylinder 32 extends between the front head 28 and the rear head 30. The cylinder 32 has a first end 36 positioned generally adjacent to the front head 28 of the housing 22 and a second end 38 positioned generally adjacent to the rear head 30 of the housing 22. The cylinder 32 defines a piston chamber 40. The chamber 40 has a generally cylindrical shape adapted to receive the piston 24. In a mounted position, the piston 24 separates the chamber 40 into a buff chamber 49 and a draft chamber 51. The buff chamber 49 represents the area between the piston 24 and the rear head 30. The draft chamber 51 represents the area between the piston 24 and the front head 28. Preferably, the piston chamber 40 has a length between 10–15 inches. However, it is to be understood that the chamber 40 can have virtually any size or dimension, without departing from the scope of the invention.

The cylinder 32 includes one or more ports 41 and 42 formed in the sidewall 43 of the cylinder 32. The ports 41 and 42 enable fluid communication between the piston chamber 40 and the reservoir 34. In the present embodiment, the ports 41 are positioned proximate to the second end 38 of the cylinder 32, enabling fluid to flow between the reservoir 34 and the buff chamber 49. Accordingly, to increase the fluid flow or flow location between the buff chamber 49 and reservoir 34, plural ports 41 can be positioned about the sidewall 43 of the cylinder 32 proximate the rear head 30.

Fluid flow through the ports 41 is controlled by check valves, wherein one of the check valves also functions as a pressure relief valve 47. During draft stroke movement of the piston 24 towards the front head 28, the check valves allow fluid to flow from the reservoir 34 into the buff chamber 49, equalizing the pressure in the chamber 49'. During a buff stroke, wherein the piston 24 moves towards the rear head 30, the check valves remain closed, preventing fluid from flowing from the reservoir 34 into the chamber 49. However, in an embodiment, pressure relief valve 47 is set to allow fluid flow from buff chamber 49 to reservoir 34 if the pressure within the buff chamber exceeds a predetermined pressure level (i.e., the structural limit of the cylinder 32) during a buff stroke. As will be appreciated by those having ordinary skill in the art, the pressure relief function can be at the ports 41 location, or any other location that communicates directly or indirectly between the buff chamber 40 and the reservoir 34.

Port 42 is positioned proximate to the first end 36 of the cylinder 32, enabling fluid to flow between the draft chamber 51 and the reservoir 34. To increase the fluid flow or location of flow between the draft chamber 51 and the reservoir 34, plural ports 42 can be positioned about the sidewall 43 of the cylinder 32 proximate the front head 28.

Fluid flow through the port 42 is controlled by a pressure relief valve 45, which can be a one-way check valve or the like. During buff stroke movement of the piston 24 towards the rear head 30, the pressure relief valve 45 is closed. Likewise, during a draft stroke, the valve 45 remains closed. However, when the pressure in the chamber 40 exceeds a predetermined pressure level during a draft stroke, the valve 45 opens, enabling fluid to flow from the draft chamber 51 into the reservoir 34 and preventing the chamber from being over-pressurized. As will be appreciated by those having ordinary skill in the art, the cracking/relief pressure magnitude of valve 45 depends on piston rod sizes and cylinder diameters. For example, in an embodiment, 400,000 lbs-ft coupler force equates to about 12,000 psi. As explained in detail further herein, in an embodiment, during buff movement the fluid flow from reservoir 34 to chamber 40 goes through check valves 55.

The reservoir 34 is in fluid communication with the piston chamber 40. The reservoir 34 extends generally between the front head 28 and the rear head 30. In the present embodiment, the reservoir 34 has a cylindrical shape. However, it is to be understood that the reservoir 34 can have virtually any shape without departing from the scope of the present invention. In an embodiment, the reservoir 34 encircles the cylinder 32, forming a generally concentric structure. Section 48 of the reservoir 34 has an inlet opening 50, which enables direct fluid communication between the reservoir 34 and the valve assembly 26.

The piston chamber 40 and reservoir 34 are charged with a gas-fluid mixture preferably containing a hydraulic oil and a high pressure nitrogen gas. Preferably, the piston chamber 40 is filled completely with oil, and most of the reservoir 34 is filled with oil when the piston is fully extended. The balance of the reservoir 34 is preferably filled with nitrogen gas, which is compressed when the piston strokes into the device. In an embodiment, the initial gas pressure with the piston fully extended is from about 200 to 1500 psi. As will be appreciated by those having ordinary skill in the art, this pressure is set by piston size, compression ratio, structural integrity and safety factor. As will also be appreciated by those having ordinary skill in the art, the piston chamber 40 and reservoir 34 can be charged with other gas and/or fluid mixtures. It is to be understood that no gas or liquid physical state limitations should be placed on the terms "gas" and "fluid" unless explicitly stated herein.

The piston 24 slidably engages the cylinder 32. The piston 24 includes a rod 56, a piston head 58 and a piston end 60. The piston 24 receives buff and draft forces acting on the coupling assembly 12. The coupler 20 (FIG. 1) and yoke 18 (FIG. 1) transmit these forces to the piston 24, moving the piston in a buff or draft direction, between a first fully-extended position, best shown in FIG. 3, and a compressed second position.

The piston head 58 has a cylindrical shape, however, as will be appreciated by those having ordinary skill in the art, the piston head can have other shapes. As previously stated, the piston head 58 is carried in the cylinder 32, separating the chamber 40 into the cylindrical buff chamber 49 and the cylindrical draft chamber 51. The piston head 58 is integrally connected to the rod 56, which extends generally outward through an opening 62 formed in the front head 28. The rod end 60 is secured to a portion of the rail car coupling assembly 12, whereupon force is applied to the piston 24 in response to buff and draft movements of the coupler 20 of the coupling assembly 12. When the valve 14 is in an unlocked position, the piston head 58, responsive to the rod 56, can move in the chamber 40 in both buff and draft directions, between a first fully-extended position and a compressed second position.

The piston head 58 has a conventional positive dynamic lockout seal 64. The seal 64 is configured to withstand extremely high pressures and velocities. The seal 64 is mounted to the circumference of the piston head 58. In this manner, the seal 64 securely seals the piston head 58 and the wall 43, preventing fluid from passing therethrough.

The piston head 58 also includes a pressure relief port 76. The port 76 extends through the piston head 58, facilitating fluid flow from the buff chamber 49 to the draft chamber 51, if needed. An overload protection valve 72 is disposed in the port 76 to control fluid flow through the port 76. The valve 72 is configured to crack at a predetermined pressure level in the buff chamber 49, thus protecting the cylinder 30, housing 22 and coupler 20 from becoming damaged by excessive pressure in the chamber 40, and specifically the buff chamber 49 as applied via the coupler 20. In the event that the impact force on the device 10 exceeds a predetermined pressure level, causing excessive pressure to the chamber 40, the flow valve 72 cracks or opens enabling fluid to flow through the piston head 58, thus relieving the pressure in the buff chamber 49. Preferably, when the coupling or impact force exerted on the coupler 20 exceeds 500,000 lbs-ft, the overload protection valve 72 will open relieving the pressure build up. As will be appreciated by those having ordinary skill in the art, the pressure to cause valve 72 to open depends on the cylinder diameter and on the coupler force chosen. In the embodiment illustrated, the cracking/relief pressure in the buff direction is about 11,500 psi, equivalent to about 500,000 lbs-ft.

The piston 24 also includes a metering pin 68. The metering pin 68 is connected to the piston head 58. The metering pin 68 extends in a generally outwardly perpendicular direction from the piston head 58. The metering pin 68 is adapted for operable engagement with the opening 74 formed in the rear head 30. In an embodiment, the metering pin 68 has a generally cylindrically tapered configuration.

The rear head 30 has an inlet opening 74 and an outlet opening 78, enabling fluid communication from the cylinder 32, and in particular the buff chamber 49, into the valve assembly 26. The rear head 30 has a fixed area orifice 80 disposed in the opening 74. The metering pin 68 is received by the orifice 80. Movement of the metering pin 68 within the orifice 80 changes the orifice fluid flow area. The orifice 80 and pin 68 are configured such that as the piston 24 moves towards the rear head 30, the frustro-conical shape of the pin 68 expands, reducing the area of the orifice, thus reducing the fluid flow through the opening 74. The reduced fluid flow via the orifice 80 increases the counter force fluid pressure on the surface of the piston head 58, which decelerates buff movement of the piston 24. The dimensions of the orifice 80 depend on several factors, including, the area of the piston 80, the mass of the freight cars (not shown), the specific gravity of the hydraulic fluid mixture, the configuration of the metering pin 68, and the stroke length of the piston 24 within the cylinder 32.

As will also be appreciated by those having skill in the art, and as explained in detail further herein, the metering pin 68 limits the fluid flow area to a single path that must be blocked to place the device 10 in lock mode (i.e., buff movement of the piston is inhibited). As such, except in an over pressure condition, a single ball valve 14 controls fluid flow within the device.

The front head 28 includes an opening 62 formed therein. The opening 62 is adapted to receive the rod 56. The front head 28 also includes a high pressure rod seal 66, which is disposed in the opening 62. The rod seal 66 seals the outer portion of the rod 56 and the opening 62, preventing fluid or pressure from escaping the cylinder 32 through the opening 62. The high pressure seal 66 is preferably a conventional multi-piece, multi-material design to seal high and low pressure over all operating temperatures, especially at low temperatures.

The front head 28 also includes one or more channels 54. Each channel 54 extends between the reservoir 34 and the cylinder 32, enabling fluid flow therethrough. The channels 54 enable fluid communication between the reservoir and the draft chamber 40 of the cylinder 32. Preferably, fluid communication typically only occurs when the piston 24 moves in a buff direction.

More particularly, in the present embodiment, the front head 28 includes plural channels 54. The channels 54 extend through the front head 28 from the reservoir 34 into the draft chamber 51. Fluid flow through the first channels 54 are each controlled by respective check valves 55. The check valves 55 open during buff movement of the piston 24, enabling fluid to flow into the draft chamber 51 from the reservoir 34, thus equalizing the pressure in the chamber 40.

The valve assembly 26 is connected to the rear head 30 of the housing 22. The valve assembly 26 generally includes a valve body 82 and the lockout valve 14. The valve body 82 has an inlet opening 84 and an outlet opening 86, which define a fluid passageway 88. The inlet opening 84 communicates with the outlet opening 78 of the rear head 30, enabling fluid to flow from the cylinder 32 into the assembly 26. The outlet opening 86 is in fluid communication with a section or portion 48 of the reservoir 34, facilitating fluid flow from the assembly 26 into the reservoir 34.

The lockout valve 14 is positioned intermediate to the passageway 88, downstream from the inlet opening 74. The lockout valve 14 can be switched between an open position and a closed position, thus controlling the flow of fluid through the passageway 88. By controlling fluid flow through the passageway 88, the lockout valve 14 controls, in part, the fluid pressure in the chamber 40, and in particular the buff chamber portion 49, and movement of the piston 24.

The lockout valve 14 can be any type of valve. Preferably, the valve is a hydraulic control valve or the like. More preferably, the lockout valve 14 is a quarter turn ball valve. The lockout valve 14 has an elastomeric valve seat 92 used to seal any space formed between the valve head and the passageway 88. In a closed position, the valve seat 92 tightly seals the valvel 4 and the passageway 88, preventing fluid flow within the passageway 88. As such, the fluid pressure in the chamber 40 prevents the piston 24 from stroking to absorb buff impacts. Stated another way, movement of the valve 14 to a closed position inhibits buff movement of the piston 24 by blocking fluid flow via passageway 88. Buff movement of the piston 24 only occurs during an over-pressure condition within the buff chamber 49 when the valve 14 is in the closed position.

In an open position, the lockout valve 14 allows fluid to flow through the passageway into the reservoir 34. The valve 14 in an open position enables the piston 24 to stroke within the cylinder. Buff movement (i.e., movement in the direction of Arrow A) of the piston 24 absorbs or cushions buff impacts.

Preferably, in a closed position, the lockout valve 14 is set to positively hold pressure in the cylinder 32 and prevent the piston 24 from stroking up to a load of 500,000 lb of force on the coupler and a fluid pressure within the buff chamber portion 49, up to about 11,500 psi. As stated previously, in an embodiment, when the coupling or impact force exerted on the coupler 20 exceeds 500,000 lbs-ft, the overload protection valve 72 will open relieving the pressure build up. As will be appreciated by those having ordinary skill in the art, the pressure to cause valve 72 to open depends on the cylinder diameter and on the coupler force chosen. In the embodiment illustrated, the cracking/relief pressure in the buff direction is about 11,500 psi, equivalent to about 500,000 lbs-ft.

Movement of the valve 14 between an open and closed position is controlled by a valve actuator 90. The valve actuator 90 can be manually controlled by an operator or electrically controlled via electrical signals. Under electrical control, the valve actuator 90 receives a command signal from the controller 93 (i.e., FIG. 1) commanding the actuator 90 to open or close the valve 14. In another embodiment, the valve actuator can be a vacuum actuator controlled by vacuum pressure or positive pressure.

Turning back to FIG. 1, in an embodiment, the logic controller 93 is configured to process, send and receive data information via signals. The controller 93 is in communication with the valve actuator 90. The controller 93 communicates with the valve actuator 90 either through coupled connection or remote connection. In a remote connection, the controller 93 uses signals to communicate with the valve actuator 90. The controller 93 switches the cushioning device 10 between a cushioning mode and locked mode by sending a command signal to the valve actuator 90 to open or close the lockout valve 14 respectively. These command signals can be digital signals, radio signals, analog signals or the like. In the preferred embodiment, the controller 93 and actuator 90 use power and activation protocols generally compatible with brake systems or other electrical control systems generally known to those in the art.

The controller 93 receives an indicating signal from a detecting device or other source. In an embodiment, the logic controller 93 receives a signal from a proximity or motion sensor 94. The proximity sensor 94 detects the movement and/or location of proximately located objects and structures. In this embodiment, the proximity sensor 94 detects the movement and location of an adjacent rail car (not shown) at a predetermined distance from the rail car 8. As such, the proximity sensor 94 sends an indicating signal to the controller 93 indicating the location and speed of movement of the adjacent car. The controller 93 processes the indicating signal. The controller 93 sends a command signal to the valve 14 commanding the valve to be in an open position, placing the device 10 in a cushioning mode to enable impact absorption.

In yet another embodiment, the locomotive sends a signal to the controller 93 indicating movement or impending movement of the train. One will recognize that there are numerous devices that can be used to send an indicating signal to the controller 93 to open or close the valve 14.

Movement of the valve 14 between an open and closed position is controlled by a valve actuator 90. The valve actuator 90 is responsive to manual control by an operator or electrical control, generally responsive to an electrical signal. Under electrical control, the valve actuator 90 receives a control signal from the controller 93 commanding the actuator 90 to open or close the valve 14. Further, another embodiment, the actuator 90 can be a vacuum actuator controlled by vacuum pressure or positive pressure.

As stated, the cushioning device 10 can be switched between a cushioning mode and locked mode, on command. In a cushioning mode 10, the valve 14 is in an open position and in a locked mode, the valve 14 is in a closed position.

Figure 3:
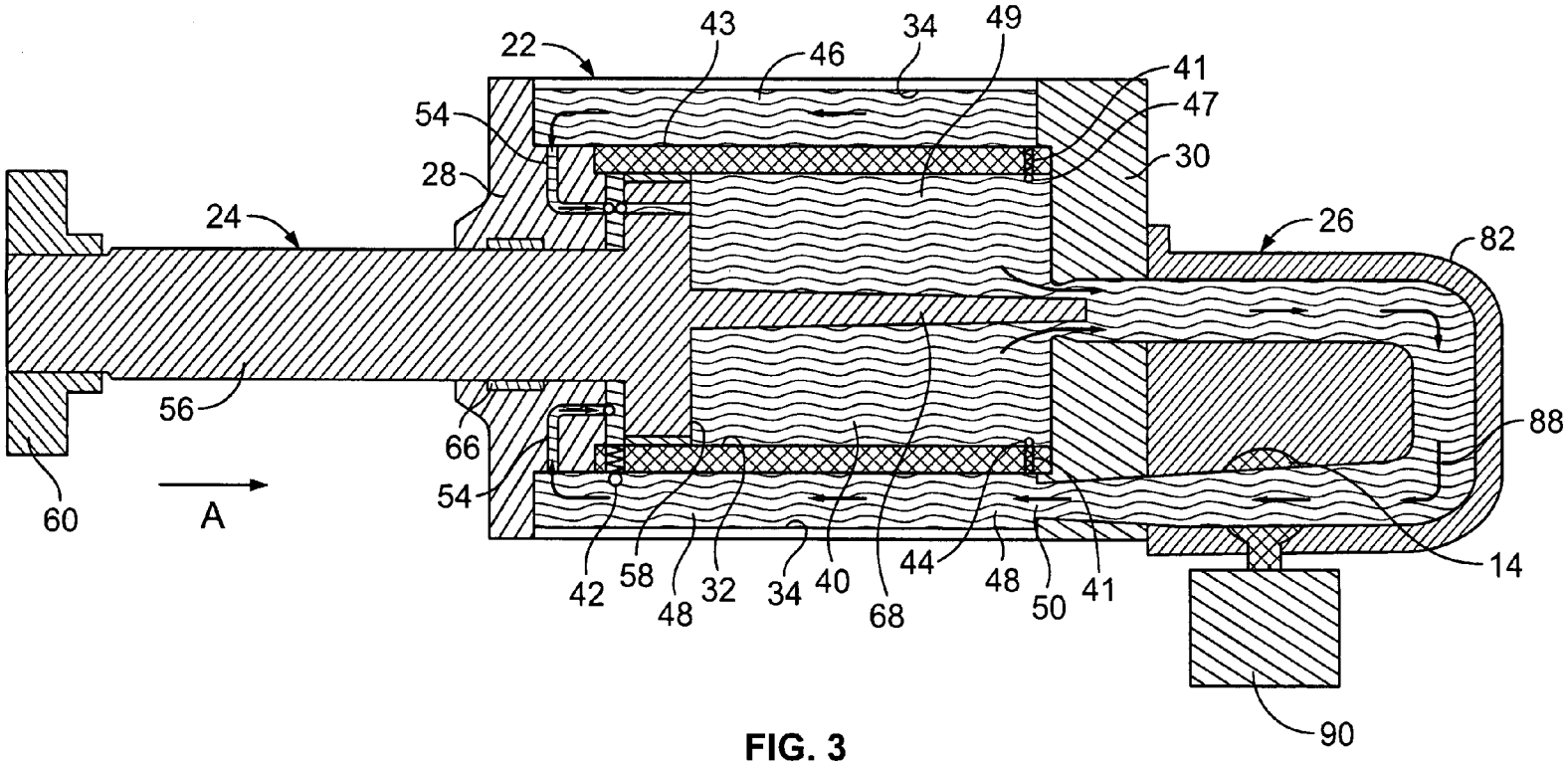
FIG. 3 is a cross-sectional side view of the cushioning device of FIG. 1, illustrating the device in an open cushioning mode with the piston in a fully extended position.
Figure 4:
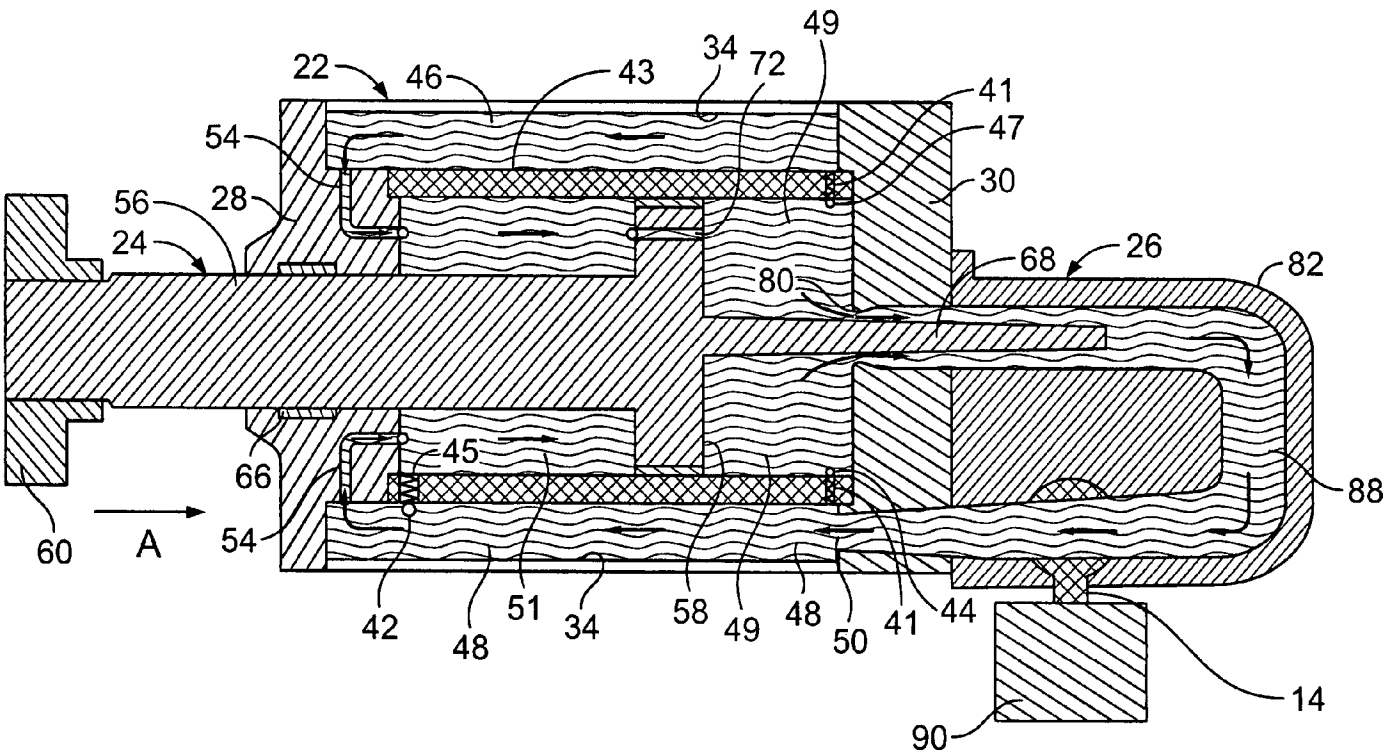
Figure 5:
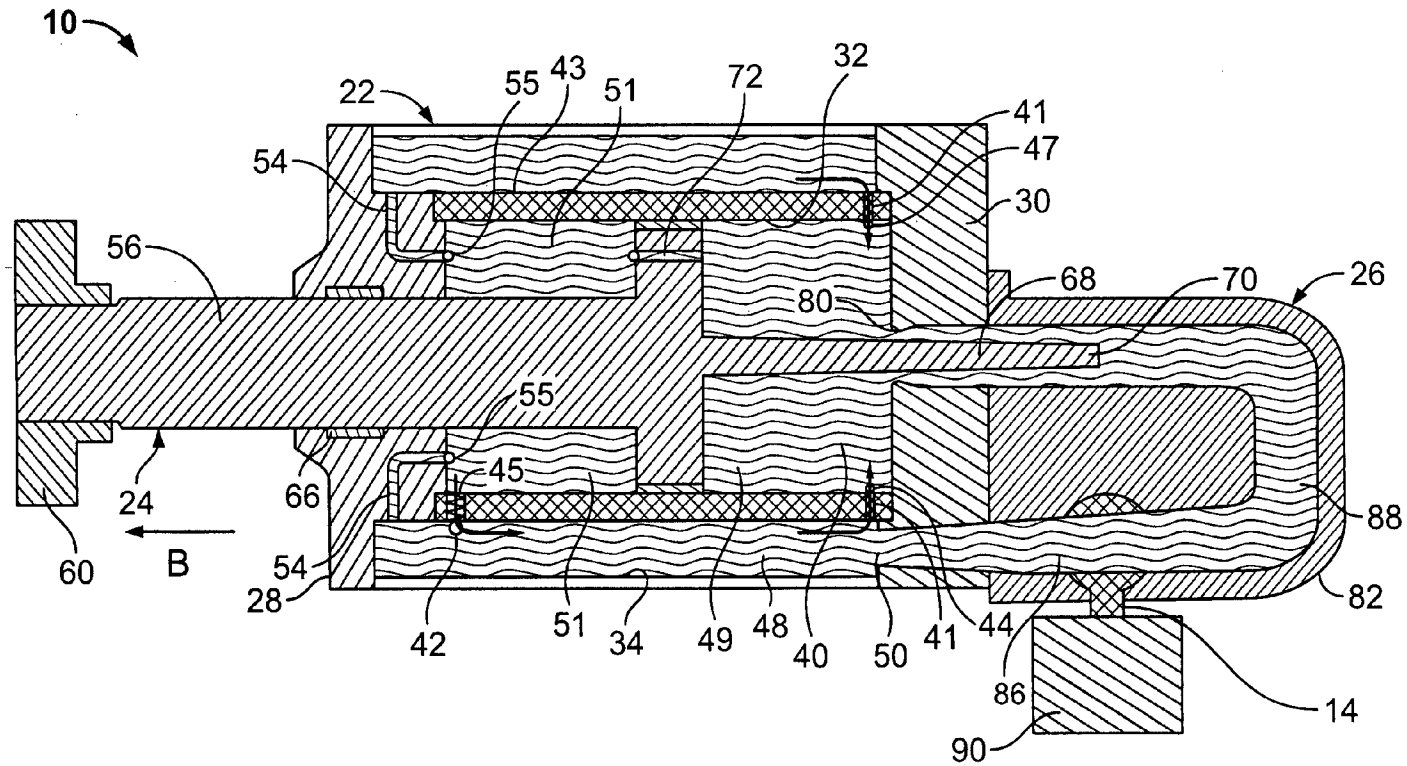
FIG. 5 is a cross-sectional side view of the cushioning device of FIG. 1, illustrating the device in an open cushioning mode with the piston in a return stoke position.

In a cushioning mode, the controller 93 sends a signal to the valve actuator 90 to open the valve 14, switching the device 10 into a cushioning mode for absorbing buff impacts. FIGS. 3–5 show the lockout valve 14 in an open position, configured to absorb buff and draft impact forces acting on the coupling assembly 12. As shown in FIG. 3, the piston 24 is in a generally fully extended, first position. In this position, the piston head 58 is positioned proximate to the front head 28 of the housing 22, enabled to perform a maximum buff stroke movement within the chamber 40 of the cylinder 32. The pressurized fluid mixture in the chamber 49 applies an internal pressure on the piston head 58 and inner wall 43 of the cylinder 32.

When the coupling assembly 12 (FIG. 1) is impacted during coupling with another rail car, resultant forces from the impact are transmitted through the coupler 20 to the piston 24. The piston 24 is urged in a buff direction (Arrow A) within the cylinder 32, towards the rear head 30 of the housing 22. As a result, with the valve 14 open and not under an over-pressure condition, fluid (e.g., oil) flows, via a single flow path, from the buff chamber 49, through the valve assembly 26, and into the reservoir 34. The check valves 47 and 44 within the buff chamber 49 prevent fluid from flowing, via ports 41 within the cylinder 32, from the buff chamber into the reservoir 34.

As shown in FIG. 4, movement of the piston 24 in the buff direction (i.e., the direction of Arrow A) reduces the volume of the buff chamber 49 and increases the volume of the draft chamber 51. This results in the pressure within the buff chamber 49 being higher than the pressure within the valve assembly passageway 88, reservoir 34, and draft chamber 51. The piston head 58 buff stroke forces the fluid contained in the buff chamber 49 through the orifice 80 into the passageway 88 of the valve assembly 26. The lockout valve 14, in an open position, allows fluid to travel through the passageway 88 into the reservoir 34. Pressure in the reservoir 34 forces fluid to travel through channels 54 back into the draft chamber 51.

As the piston 24 moves in the buff direction, the metering pin 68 engages the orifice 80, and fluid flows through the orifice 80 into the valve assembly 26. The tapered configuration of the metering pin 68 reduces the flow area of the orifice 80. As stroke length of the piston 24 moving towards the rear head 30 increases, the tapered configuration of the metering pin 68 reduces the area of the orifice 80. As such, a substantial pressure is generated against the face of the piston head 58. The magnitude of the pressure of fluid is generally proportional to the flow velocity and area of the orifice 80. The pressure in the buff chamber 49 generates a counter force on the face of the piston head to smoothly reduce buff movement of the piston 24. The counter force on the piston 24 is transmitted to the coupler 20 (FIG. 1), decelerating the moving freight car. The hydraulic compression counterforce is maintained at a relatively constant level by the pin 68 orifice 80 arrangement, smoothly and safely decelerating the coupler and protecting lading from high inertial forces.

As stated previously, during the buff stroke of the piston 24, the valves 44 and 47 within the buff chamber 49 remain closed, preventing fluid from flowing from the buff chamber into the reservoir 34 via ports 41. In addition, fluid flows through channels 54 into the draft chamber 51.

After impact, internal fluid pressure in the buff chamber 49 and recoil of the coupler 20 (FIG. 1) force the piston 24 to move in a draft direction, towards the front head 28 of the cylinder 32, as best seen by Arrow B in FIG. 5. As the piston 24 moves in the draft direction, the volume of the draft chamber 51 decreases and the volume of the buff chamber 49 increases. Fluid in the draft chamber 51 is forced through valve 42. As the piston 24 returns, the fluid mixture fills the buff chamber 49. During draft stroke movement by the piston 24 towards the front head 28, the check valves 44 and 47 allow fluid to flow from the reservoir 34 into the buff chamber 49, equalizing the pressure in the chamber 49.

The oil exiting the draft chamber 51 is metered, by port 42 because the port provides the only path for the oil to escape the draft chamber since the check valves 55 are closed. Accordingly, the metered flow provides for control of the piston return speed.

As stated previously, the oil enters the buff chamber 49 from the fluid passageway 88 and the ports 41 as a result of the check valves 44 and 47 being open. Preferably, most of the oil enters the buff chamber 49 from the passageway 88.

Turning back to FIG. 1, in the event of train movement, the cushioning device 10 can be switched to a locked mode, on command. The controller 93 receives a signal from an outside source, such as the proximity sensor 94 which indicates to the controller 93 to close the lock out valve 14. In this manner, the controller 93 sends a signal to the actuator which moves the valve 14 into a closed position, preventing fluid flow through the passageway 88. The fluid pressure in the buff chamber 49 prevents the piston 24 from stroking, thus locking the device 10. In a locked mode, fluid flow within the device 10 is prevented by an electrically actuated lockout valve 14, forming a generally rigid structure.

Figure 6:
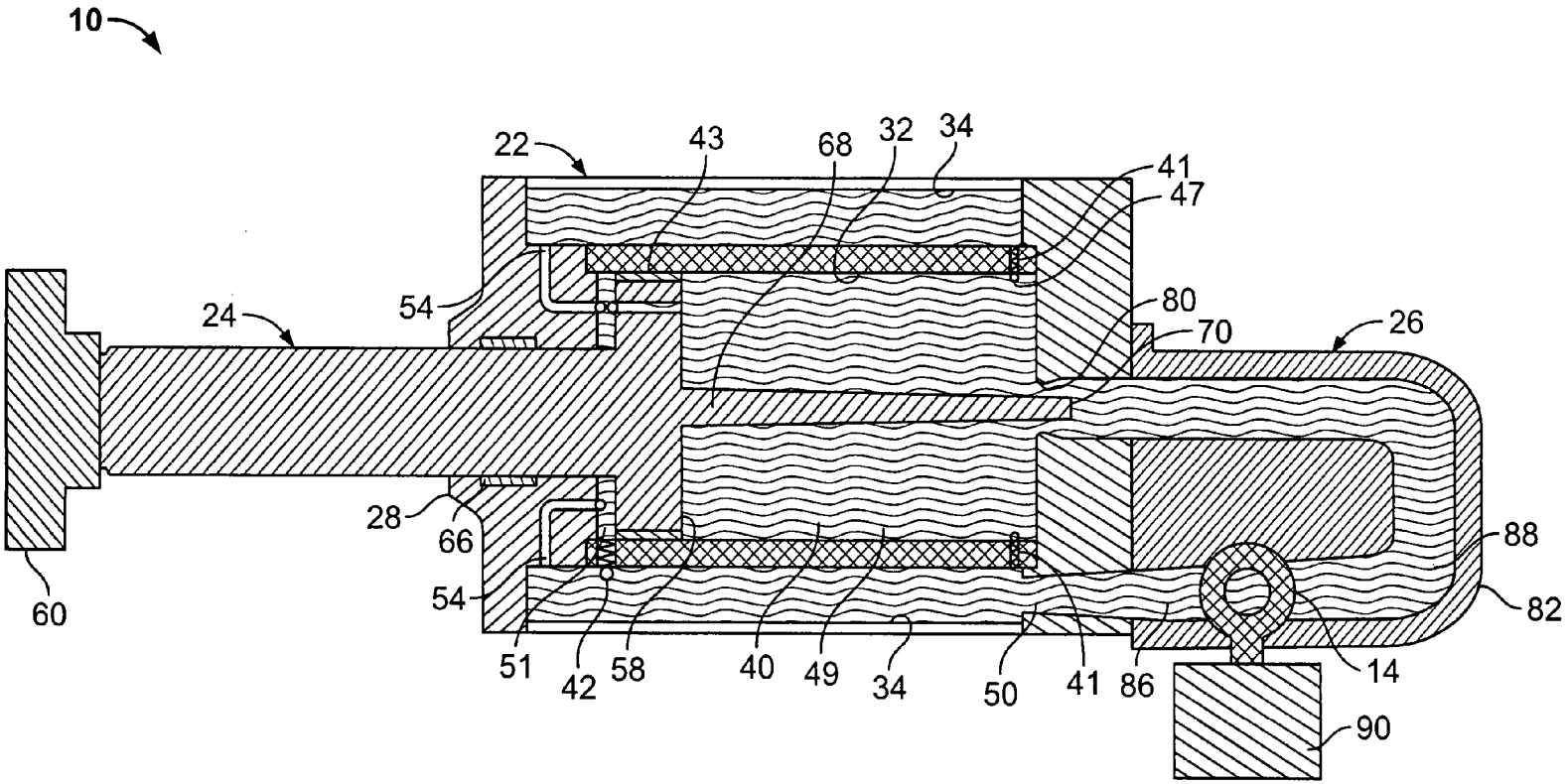
FIG. 6 is a cross-sectional side view of the cushioning device of FIG. 1, illustrating the device in a closed locked mode, with the piston in a fully extended first position.
Figure 7:
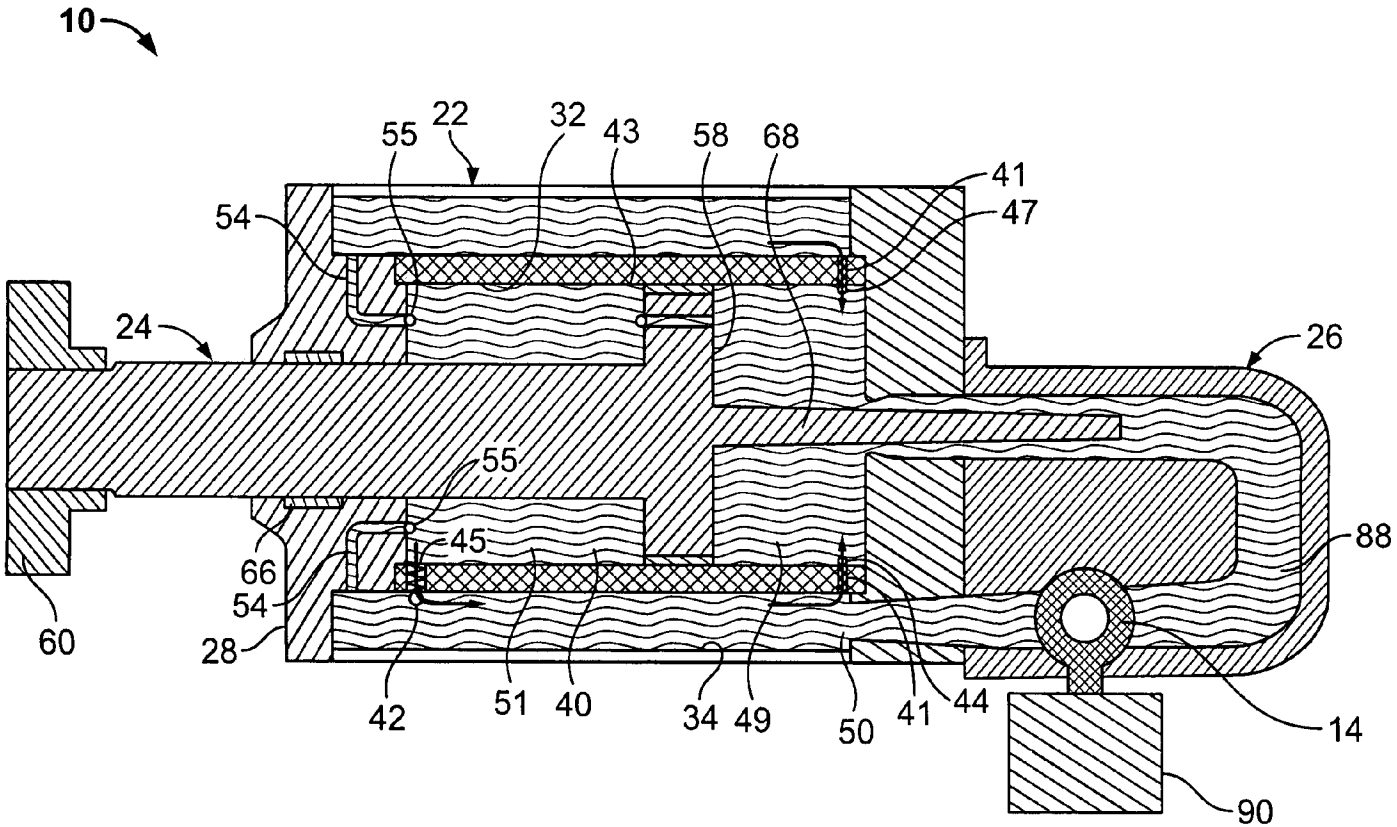
FIG. 7 is a cross-sectional side view of the cushioning device of FIG. 1, illustrating the piston in a closed locked mode, with the piston in a return stroke position.

FIGS. 6 and 7 illustrate the cushioning device 10 in a locked mode. As such, the lockout valve 14 is actuated by the controller 93 to a closed position. Accordingly, the pressure locks the piston position preventing the piston 24 from stroking. FIG. 6 shows the piston rod in a fully-extended position, first position. In this position, the piston head 58 is positioned generally adjacent to the front end or head 28 of the cylinder 32. When the valve 14 is moved into a locked position, fluid flow through the orifice 80 and into the reservoir 34 via passageway 88 is prevented. Accordingly, fluid can only exit the buff chamber 49 and enter into the reservoir 34 upon cracking open the pressure relief valve 47 upon a run-in or inadvertent impact that exceeds the predetermined threshold of the valves.

In the locked position, the cushioning device 10 is allowed to return stroke to a fully-extended first position as a result of the pressure provided by the gas-fluid mixture within reservoir 34. FIG. 7 shows the piston head 58 performing a return stroke while the valve 14 is in a locked position. During the return stroke, the piston 24 is moved into a fully extended position. As the piston head 58 moves towards the front head 28, the volume of the buff chamber 49 is increased as fluid enters from the reservoir 34 through the open check valves 44 and 47 into the buff chamber. Accordingly, the volume of the draft chamber 51 is decreased. In this manner, the decreased volume and piston head 58 forces fluid out of the draft chamber 51 into the reservoir 34. This fluid flow is controlled through port 42 as a result of check valves 55 being closed and check valve 45 being open.

As stated previously, and turning back to FIG. 1, the controller 93 receives an indicating signal from an indicator. In an embodiment, the indicator is a proximity or motion sensor 94 used to detect movement of proximate or incoming structures. In this manner, the sensor 94 detects a rail car (not shown) moving towards the sensor 94 at a predetermined distance from the rail car 8 and sends a signal to the controller 93 indicating to the controller 93 the location and the speed of the incoming car. The controller 93 processes this signal and sends a command signal to the valve actuator 90 to open the valve 14 in order to cushion a potential impact of the incoming rail car.

In another embodiment, the controller 93 is in communication with the departure inspection or a locomotive. In this manner, the controller 93 receives a signal from the locomotive or another source indicating the travel status of the train. In the event that the locomotive is set to leave, the locomotive sends an indicating signal to the controller 93. The controller 93 processes the indicating signal and sends a signal to the actuator 90 commanding the actuator 90 to close the valve 14, thus switching the device 110 into a locked mode.

Figure 8:
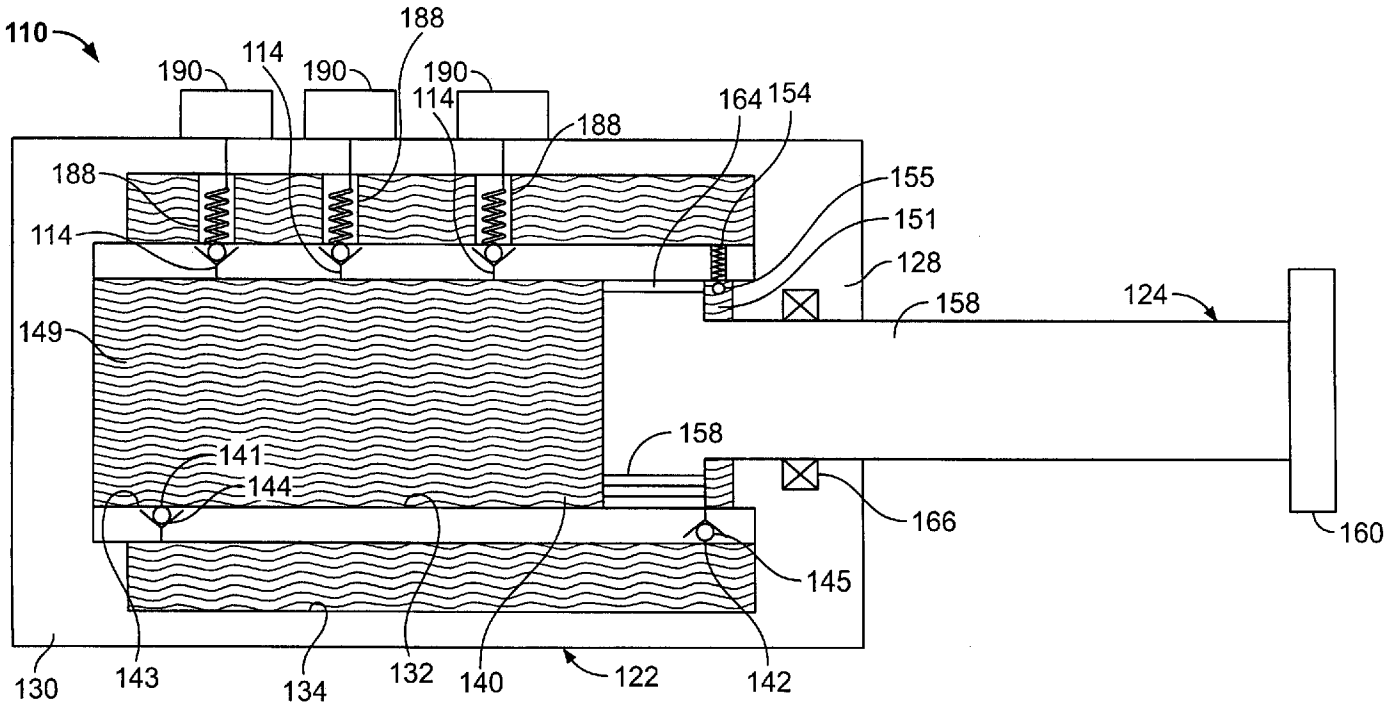
FIG. 8 is a cross-sectional side view of another embodiment of a cushioning device in accordance with the present invention having electrically actuated valves positioned about the outer chamber of a cylinder.

FIG. 8 illustrates another embodiment of a cushioning device 110 in accordance with the present invention. In this embodiment, the device 110 is switched between a cushioning mode and lockout mode by controlling the flow between the cylinder chamber 140 and the reservoir 134 using a plurality of valve members 114 located on the inner wall 143 of the cylinder 132. The cylinder 132 includes one or more ports 141, 142, 154 and 188 located on the inner wall 143 of the cylinder 132. The ports 141, 142, 154 and 188 communicate fluid between the cylinder chamber 140 and reservoir 134. Fluid flow through ports 188 are controlled by electrically actuated valves 114. The valves 114 are each controlled directly by a valve actuator 190 connected to a controller (not shown). The valve actuator 190 receives a command signal from the controller to open or close the valves 114.

In an open position, fluid is allowed to flow between the buff chamber 149 and reservoir 134, thereby allowing the piston 124 to stroke in the chamber 140, and thus enabling the device 110 to absorb impacts. In an embodiment, the valves 114 can be preloaded to switch from a normal or typical relief setting, to a higher or locked mode relief setting. In an embodiment, the valves 114 are opened and closed according to the position of the piston 124. In a cushioning mode for a buff impact, the valves 114 located on the buff side of the piston are open to allow fluid to flow from the buff chamber 149 into the reservoir, and valve 155 located on the draft chamber 151 is opened to allow fluid to flow from the reservoir 134 into the draft chamber 151. Conversely, the valves 114 are closed to place the device 110 in a locked mode, wherein fluid is prevented from exiting the buff chamber 149 except during an over pressure condition.

In an embodiment, fluid flow through the port 142 is controlled by a pressure relief valve 145. During buff stroke movement of the piston 124, the pressure relief valve 145 can, if desired, allow fluid to flow from the reservoir 134 into the draft chamber 151, equalizing the pressure in the chamber and reservoir 134. During a draft stroke, the valve 145 opens to allow fluid to escape the draft chamber 151 wherein flow control is maintained by the port 142 during the return of the piston.

Figure 9:
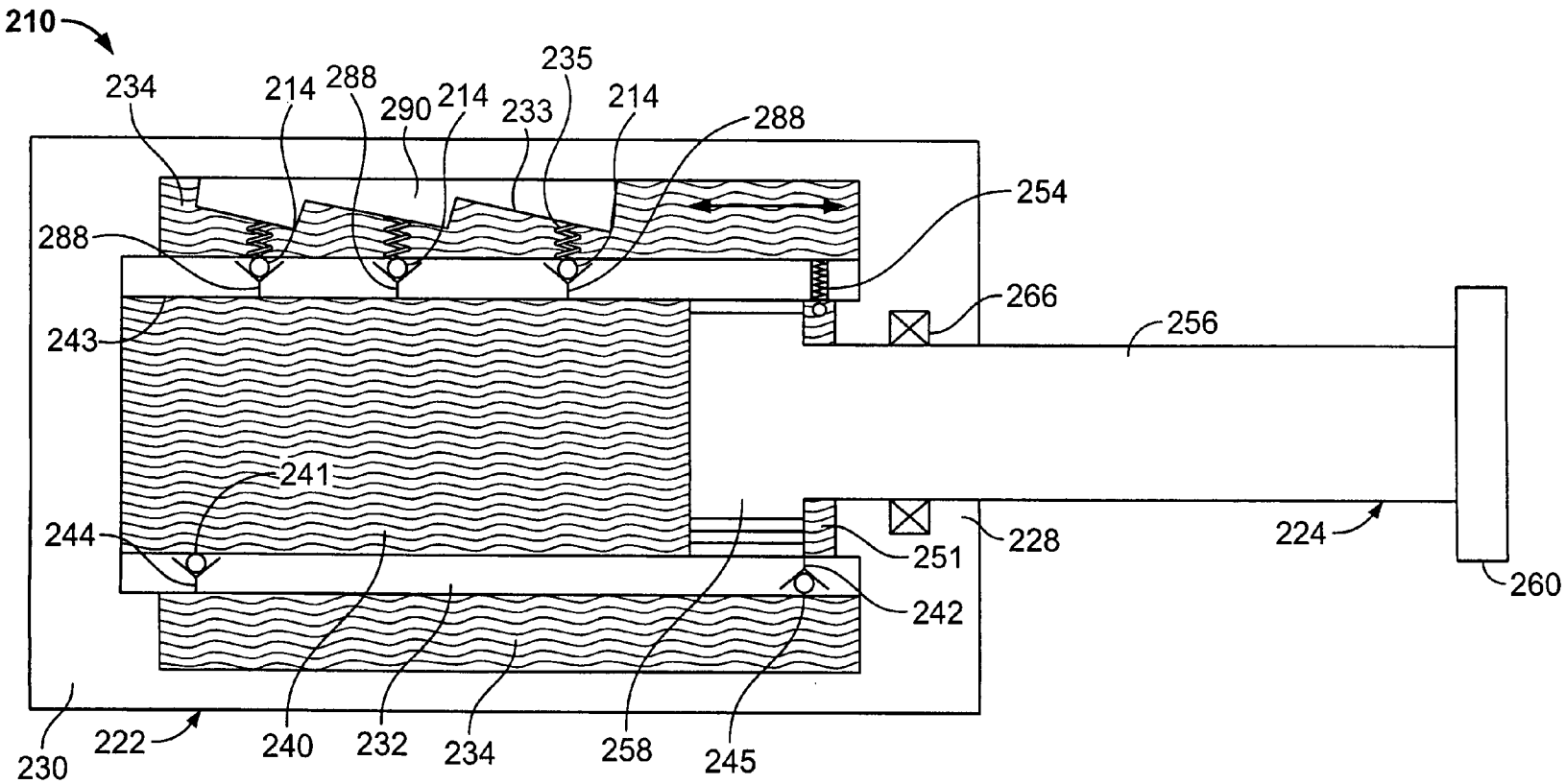
FIG. 9 is a cross-sectional side view of yet another embodiment of a cushioning device in accordance with the present invention having electro-mechanically controlled sliding member.

FIG. 9 illustrates another embodiment of a cushioning device 210 in accordance with the present invention. In this embodiment, the cushioning device 210 has an electronically actuated sliding member or valve actuator 290 with inclined engaging surfaces. One or more ports 241, 242, 254 and 288 are located on the inner wall 243 enabling fluid to flow between the cylinder chamber 240 and reservoir 234. Valve members 114 control fluid flow through one or more of the ports 188. Movement of the sliding member 290 is provided by an actuator (not shown). The sliding member 290 has inclined surfaces which depress the back of the valves 114 opening and closing the valves 114. The sliding member 290 slides about the cylinder 232 longitudinally in the reservoir 234 to regulate the valves. In a generally closed position, the top of the inclined sliding member depresses the valves 214 into a closed position preventing fluid flow therefrom. To open the valves 214, the inclined sliding member is moved such that the bottom of the inclined portion engages the back portion, enabling the valve to lift into an open position.

As indicated previously, the one or more valves can have a preload setting that can be switched. For example, within FIGS. 8 and 9, the preload setting of the valves can be switched from a typical or normal 50,000 to 100,000 lbs-ft to a locked mode preload of 500,000 to 800,000 lbs-ft or more. Preferably, in the locked mode, the preload stiffness is as great as the structural stiffness of the railcar underframe.

Figure 10:
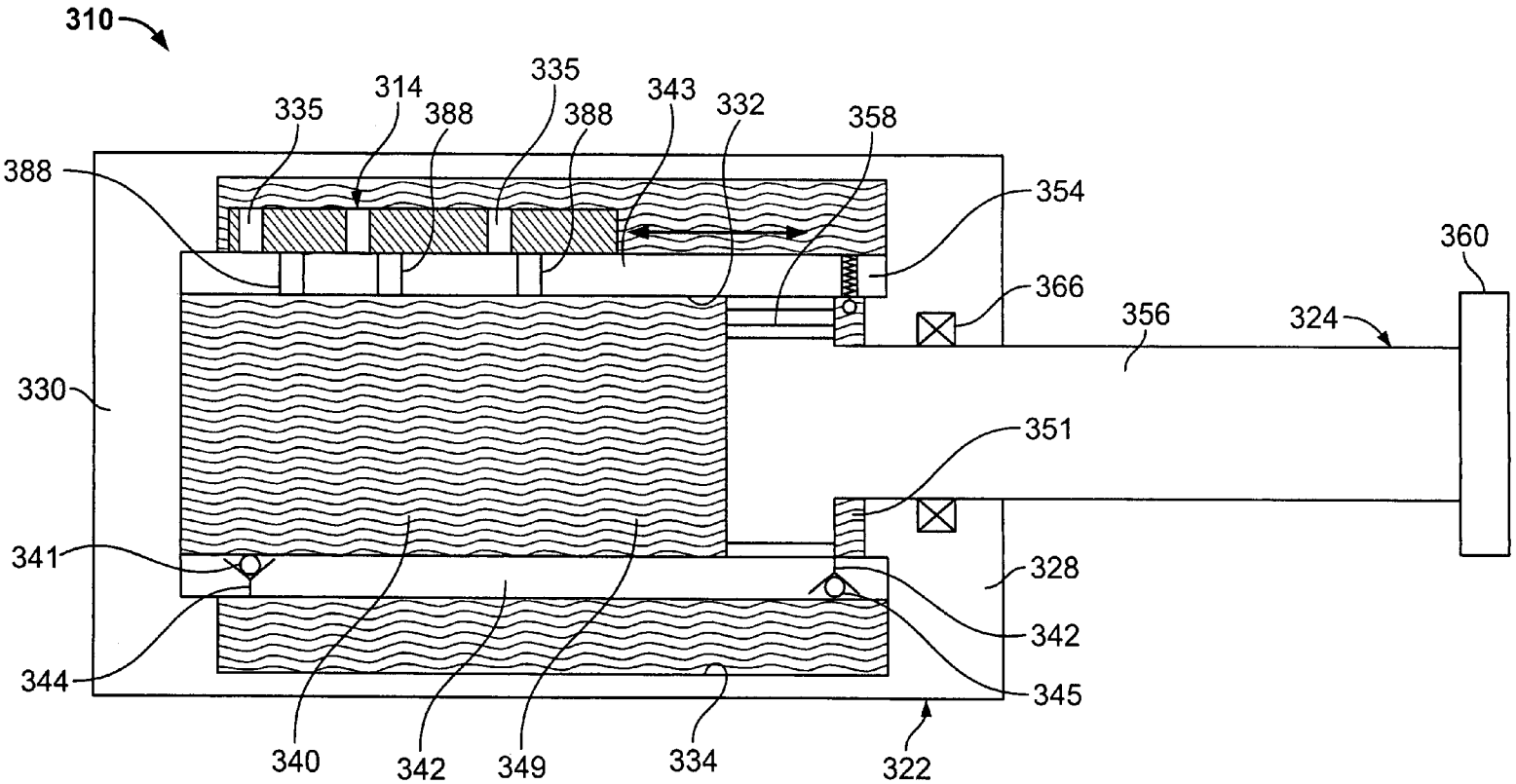
FIG. 10 is a cross-sectional side view of a further embodiment of a cushioning device in accordance with the present invention having an a electrically actuated sliding port member; and, FIG. 11 is a cross-sectional view of an additional embodiment of an electrically actuated cushioning device in accordance with the present invention.

FIG. 10 is a cross-sectional view of another embodiment of a cushioning device 310 in accordance with the present invention. The cylinder 332 includes a plurality of ports 341, 342, 354 and 388 extending through the sidewall of the cylinder 332 for enabling fluid to flow between the cylinder chamber 340 and the reservoir 334. Fluid flow from the ports 388 is controlled by an slidable member or valve 314 positioned along the outside of the cylinder 332, adjacent to the reservoir 334. The valve member 314 includes a plurality of ports 335 extending therethrough. Movement of the valve member 314 provides for controlling fluid flow through the ports 388. The slidable valve member 314 is controlled by a valve actuator (not shown). When the ports 335 in the slidable valve member 314 are aligned with the ports 388, fluid is permitted to flow between the reservoir 334 and buff chamber 349. When the ports 335 in the slidable member 315 are misaligned, the ports 388 are blocked and fluid is prevented from flowing between the buff chamber 340 and the reservoir 334.

In an embodiment, electrical actuation to move sliding valve member 314 from a closed to open position is augmented or replaced by an inertia spring mass system. Under relatively high accelerations during impact, the flow path aligns to permit flow. When in a train, ordinary longitudinal accelerations due to train action would not allow flow, essentially keeping the device in a locked mode.

Figure 11:
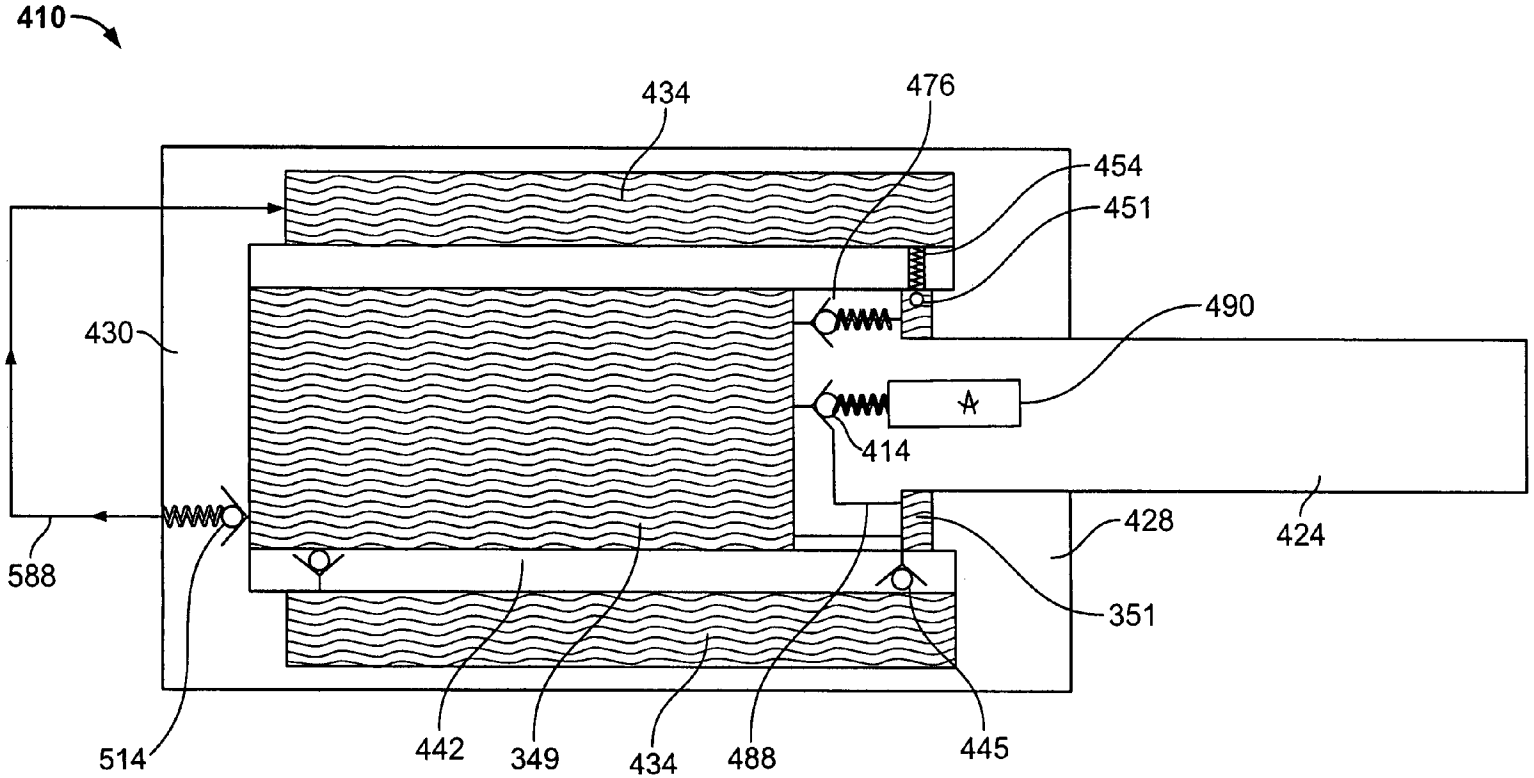

Turning to FIG. 11, a flow control valve 414 is provided that controls flow from buff chamber 449 to 451, directly through piston 458, via flow path 488. In an alternative embodiment, a flow control valve 514 is provided for controlling the flow, via flow path 588, between the buff chamber 449 and the reservoir 434. In these embodiments, the control valves replace the metering pin or orifices in the cylinder wall as depicted in FIG. 2.

The cushioning device described herein provides impact protection between colliding bodies during coupling operations. The controller and valve provide an on command lockout feature by positively controlling the stroke of the piston. The ability to lockout the cushion devices before train action, preventing the cushion device from stroking, significantly reduces slack action and resulting inter-car velocities and forces. By locking out the cushioning device, a more stiffened train is created which is safer to operate, provides a significantly improved ride-quality, and reduced lading damage.

While the specific embodiments have been illustrated and described, numerous modifications come to mind without significantly departing form the spirit of the invention and the scope of protection is only limited by the scope of the accompanying claims.

What is claimed is:

1. A rail car cushioning device connected to a coupler, being switchable between a locked mode and a cushioning mode, comprising:

a housing comprising a hydraulic cylinder, a front head, a rear head and a reservoir, the hydraulic cylinder extends between the front head and the rear head defining a chamber;

a piston, comprising a piston rod extending through the front head into the chamber and a piston head carried in the piston chamber, the piston being responsive to buff and draft impacts, and the piston having a metering pin extending outwardly from the piston head towards the rear head and the rear head has an opening with an orifice disposed therein, the metering pin having a tapered cylindrical configuration adapted for engagement with the orifice; and, a valve assembly in fluid communication with the cylinder including a valve body having an inlet opening and an outlet opening defining a passageway, a valve member interposed in the passageway being movable between an open position and a closed position to control fluid flow through the passageway.

2. The cushioning device of claim 1 wherein in a cushioning mode, the valve is in an open position enabling fluid to communicate between the cylinder and reservoir via the valve assembly enabling the piston to stroke between a first and second position in the cylinder in response to buff and draft impacts on a coupler.

3. The cushioning device of claim 1 wherein in a locked mode, the valve is in a closed position, preventing fluid from flowing though the valve assembly, preventing the piston from stroking, forming a relatively rigid structure.

4. The cushioning device of claim 1 wherein the valve assembly further comprises a valve actuator for controlling movement of the valve member.

5. The cushioning device of claim 1 further comprising a controller in communication with the valve actuator for controlling the valve.

6. The cushion device of claim 5 wherein the controller processes an indicating signal and transmits a commanding signal to the valve actuator to open or close the valve.

7. The cushioning device of claim 5 wherein a proximity sensor detects the movement of an approaching car and sends an indicating signal to the controller.

8. The cushioning device of claim 1 wherein movement of the piston in a buff direction causes the metering pin to engage the orifice, thus continuously reducing the area of the orifice.

9. The cushioning device of claim 1 including a port extending through the piston head enabling fluid flow therethrough.

10. The cushioning device of claim 9 including an overload protection valve extending through the piston head.

11. The cushioning device of claim 1 wherein the piston head has a dynamic pressure seal connected to the outer surface of the piston head for preventing fluid from passing between the piston head and inner wall of the cylinder.

12. The cushioning device of claim 1 wherein the opening in the front head includes a rod seal disposed therein.

13. The cushioning device of claim 1 wherein the cylinder includes one or more ports located in the inner wall enabling fluid to flow between the cylinder and reservoir.

14. The cushioning device of claim 1 wherein the front head includes at least one channel extending between the reservoir and draft chamber enabling fluid to flow into the draft chamber during buff movement of the cylinder.

15. The cushioning device of claim 1 wherein the front head includes a channel extending from the upper portion of the reservoir and the draft chamber and a channel extending between the lower portion of the reservoir and the draft chamber.

16. The cushioning device of claim 1 further comprising at least one channel extending between the reservoir and draft chamber enabling fluid to flow into the draft chamber during buff movement of the cylinder.

17. The cushioning device of claim 1 wherein in a locked mode, fluid flows between the reservoir and cylinder enabling the piston to return to a first position.

18. The cushioning device of claim 1 wherein the controller receives a signal from the locomotive indicating impending train movement the controller sends a signal to the actuator switching the device into a locked mode.

19. The cushioning device of claim 1 including one or more ports located in the inner wall proximate to the front head enabling fluid flow between the reservoir and the draft chamber.

20. The cushioning device of claim 1 including one or more ports located in the inner wall proximate to the rear head enabling fluid flow between the reservoir and the buff chamber, and a one-way check valve disposed in the port enabling fluid to flow into the buff chamber from the reservoir during draft movement of the piston.

21. A rail car cushioning device being switchable between a locked mode and a cushioning mode, the cushioning device comprising:

a housing including a cylinder, front head and rear head, defining a hydraulic chamber and reservoir;

a front head and rear head, the front head having an aperture adapted to receive a piston rod, the rear head having a first opening defining a passageway and a second opening defining an orifice adapted to receive a metering pin;

the cylinder extending between the front head and rear head to define a hydraulic chamber adapted to receive a piston;

a reservoir adjacent to the cylinder including at least one relief port enabling fluid communication the cylinder, said relief port controlled by a check valve;

a valve assembly adjacent to said rear head comprising, a valve body having an inlet opening and an outlet opening defining a passageway for fluid to flow therethrough, a lockout valve member interposed in said passageway having a valve actuator responsive to a control signal to open and close said valve member;

a piston assembly including a piston rod extending through the front head into said chamber, a piston head connected to said rod being carried in said chamber including at least one piston seal for providing sealing contact with the inner wall of said chamber, a metering pin extending from the piston head for cooperative engagement with said orifice, the metering pin having a tapered cylindrical configuration adapted for engagement with the orifice; and, wherein when said valve member is in an open position, said piston is movable in said chamber enabling impact protection and when said valve member is in a closed position, the pressure in the chamber prevents the piston from stroking, thereby locking the device.

* * * * *